United States Patent [19]

Bothner et al.

[11] Patent Number: 4,922,580

[45] Date of Patent: May 8, 1990

[54] SLIVER GUIDE CONDUIT

[75] Inventors: Jakob Bothner, Goppngen-Jebenhausen; Axel Marg, Ebersbach, both of Fed. Rep. of Germany

[73] Assignee: Zinser Textilmaschinen GmbH, Ebersbach, Fed. Rep. of Germany

[21] Appl. No.: 300,036

[22] Filed: Jan. 19, 1989

[30] Foreign Application Priority Data

Jan. 21, 1988 [DE] Fed. Rep. of Germany ..... 3801688

[51] Int. Cl.[5] ..... D01G 5/74

[52] U.S. Cl. ..... 19/288

[58] Field of Search ..... 19/288; 57/315, 332, 57/333, 328

[56] References Cited

U.S. PATENT DOCUMENTS

| | | | |
|---|---|---|---|
| 984,195 | 2/1911 | Cooper . | |
| 2,840,860 | 7/1958 | Raper . | |
| 4,763,387 | 8/1988 | Bothner | 19/288 |
| 4,807,431 | 2/1989 | Braxmeier | 57/328 |

FOREIGN PATENT DOCUMENTS

| | | | |
|---|---|---|---|
| 3034812 | 4/1981 | Fed. Rep. of Germany . | |
| 3336294 | 4/1984 | Fed. Rep. of Germany . | |
| 3612133 | 12/1986 | Fed. Rep. of Germany . | |
| 531573 | 1/1973 | Switzerland . | |
| 2059474 | 4/1981 | United Kingdom | 19/288 |

*Primary Examiner*—Werner H. Schroeder
*Assistant Examiner*—D. Price
*Attorney, Agent, or Firm*—Shefte, Pinckney & Sawyer

[57] ABSTRACT

A sliver guide conduit extending between the output and calendar rollers of a draw frame or like spinning preparation machine is of a bipartite construction having an upstream conduit section extending into the interior area of a downstream conduit section, with an air conduit opening tangentially into the interior of the downstream conduit section annularly about the upstream section for admitting an airstream to assist in drawing a sliver through the sliver guide conduit during machine start-up.

6 Claims, 1 Drawing Sheet

SLIVER GUIDE CONDUIT

BACKGROUND OF THE INVENTION

The present invention relates to a sliver guide conduit for transporting a traveling silver between the serially-arranged output and calendar rollers of a textile spinning preparation machine, such as a textile draw frame, wherein an arrangement is provided for directing an airstream into the silver guide conduit.

West German Patent Application No. P 36 12 133.9 discloses the provision of a housing located upstream of the calendar rollers in a textile draw frame or like spinning preparation machine for supporting a cylindrical silver guide conduit into which an airstream empties to produce a transporting action on the silver in the interior area of the guide conduit downstream of the point of entry of the airstream.

Silver guide conduits in textile machines are also known wherein the conduit is of a bipartite, or two-piece, construction having one conduit section which extends into another conduit section, such as representatively disclosed in Japanese Patent Application No. 59-194976, but such silver conduit is not used between the output and calendar rollers of a draw frame or similar spinning preparation machine for transporting the silver therebetween.

British Patent Application No. 2,079,798 discloses a conduit arrangement utilized in the processing of continuous thermoplastic filaments for fluid transportation thereof, the conduit arrangement including one conduit section having a conical end which extends into an opening in the form of a truncated cone in a following conduit section.

SUMMARY OF THE INVENTION

In contrast to the above, the present invention has the object of providing a silver guide conduit adapted for improving in a simple manner the transport action of a silver between the output rollers and calendar rollers of a textile draw frame or similar spinning preparation machine.

Briefly summarized, the silver guide conduit of the present invention is of a bipartite construction having an upstream conduit section arranged to receive the silver from the output rollers of the spinning preparation machine and a downstream conduit section arranged to discharge the silver to the calendar rollers of the machine. The upstream conduit section has a terminal end extending interiorly within the downstream conduit section and an air conduit arrangement is associated with the silver guide conduit for directing an airstream interiorly into the downstream conduit section generally tangentially thereto at a location upstream of the terminal end of the upstream conduit section. In this manner, a rotational current of the airstream is generated within the downstream conduit section to impart corresponding rotation to the silver. As a result, the guide conduit acts as a nozzle-type injector to produce a transporting action on the silver effective back to the area of the output roller of the spinning preparation machine.

In the preferred embodiment of the silver guide conduit, the downstream conduit section defines a frusto-conical interior area receiving the terminal end of the upstream conduit section which also preferably is of a frusto-conical shape, which together provide an enhanced injector action of the airstream entering through the air conduit arrangement.

According to another feature of the invention, the downstream conduit section also defines an interior silver transport area, preferably cylindrical, which extends downstream from the conical interior area to the calendar rollers. Further, the downstream conduit section and the air conduit arrangement may be formed as an integral one-piece unit to simplify the construction and manufacture of the conduit.

DESCRIPTION OF THE PREFERRED EMBODIMENT

Figure 1:
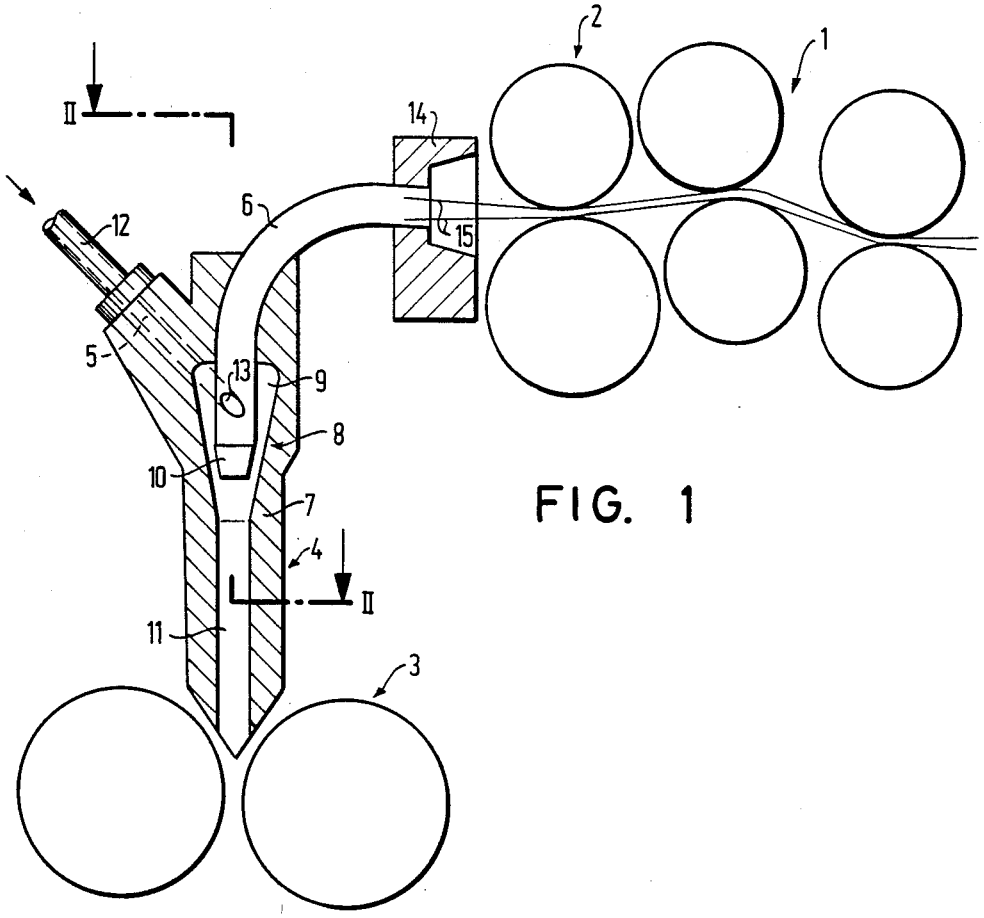
FIG. 1 is a schematic view, partially in side elevation and partially in vertical cross-section, of a textile draw frame incorporating a silver guide conduit according to the preferred embodiment of the present invention.

Referring now to the accompanying drawings and initially to FIG. 1, a textile draw frame is schematically shown, including a drafting system 1 having a series of pairs of output drafting rollers 2 and a pair of calendar rollers 3 serially-arranged with respect to the output rollers 2 at a spacing downstream therefrom along the path of travel of a silver 15. A silver guide conduit 4 extends between the output rollers 2 and the calendar rollers 3 for transporting the traveling silver therebetween, the silver guide conduit 4 being of a bipartite construction including an upstream conduit section 6 having an inlet end arranged adjacent the nip of the last downstream pair of output rollers 2 to receive the silver therefrom and a downstream conduit section 7 into which the opposite outlet end 8 of the conduit section 6 extends to discharge the silver thereinto and which is arranged to extend to the nip area of the calendar rollers 3 to discharge the silver thereto. A silver funnel 14 is preferably mounted to the entrance end of the upstream conduit section 6 to direct the silver into the conduit section 6. As more fully explained below, an air conduit 5 is associated with the silver guide conduit 4 to empty tangentially into the conduit section 7 upstream of the outlet end 8 of the conduit section 6.

The downstream conduit section 7 of the silver guide conduit 4 defines a continuous interior conduit area 9,11 extending from a location upstream of the outlet end 8 of the upstream conduit section 6 to a discharge opening at the nip area of the calendar rollers 3. The interior wall of the downstream conduit section 7 defining the upstream area 9 of the conduit interior, wherein the outlet end 8 of the upstream conduit section 6 is disposed, has a sufficiently larger diameter than the conduit section 6 to provide an open annular area thereabout and extends at a converging taper angle in the downstream direction to define the area 9 of a truncated or frusto-conical shape. Correspondingly, the outer periphery of the terminal outlet end 8 of the upstream pipe section 6 disposed within the interior area 9 of the conduit section 7 is similarly profiled of a frusto-conical shape as indicated at 10. The discharge end of the air conduit 5 is arranged to empty tangentially at 13 into the frusto-conical interior area 9 of the conduit section 7 annularly about and upstream of the outlet end 8 of the conduit section 6. The air conduit 5 is fitted with an extension tube 12 to facilitate connection with a suitable source of compressed or pressurized air not shown. The interior wall of the conduit section 7 defining the interior conduit area 11 downstream of the frustoconical area 9 is substantially cylindrical.

As will thus be understood, the bipartite construction of the silver guide conduit 4, with the conduit sections 6,7 being configured and arranged to define the frustoconical area 9 within the interior of the conduit section 7 annularly about and upstream of the discharge end 8 of the conduit section 6, forms an annular nozzle for injecting an airstream from the air conduit 5 into the conduit section 7 which serves to improve the transport of the silver through the entire length of the silver guide conduit 4 from the entrance funnel 14 at the output drafting rollers 2 to the discharge point at the calendar rollers 3. Specifically, upon any start-up of operation of the draw frame, such as after a silver breakage occurs, a leading end of the silver 15 is positioned at the entrance funnel 14 and then a stream of compressed air is introduced through the connection pipe 12 and the air conduit 5 tangentially into the frusto-conical interior area 9 of the silver conduit from which the air then flows through the cylindrical interior area 11. The nozzle configuration formed by the conduit section 6,7 causes this air flow to generate an injector-like action which, in turn, creates a suction force through the upstream conduit section 6 to draw the silver 15 into and through the funnel 14 and the conduit section 6 and to then blow the silver 15 through the cylindrical area 11 of the conduit section 7 into the nip region between the calendar rollers 3. In this operation, the tangential introduction of the compressed airstream into the frustoconical area 9 induces the airstream to flow in a rotational current through the conduit areas 9,11 and, as a result, produces rotation of the silver 15 which advantageously combines the individual fibers of the silver 15 in a twisting-like manner to improve the cohesion of the silver fibers for more effective and reliable introduction of the silver into the nip of the calendar rollers 3.

As necessary or desirable, the introduction of compressed air into the connection tube 12 and the air conduit 5 may be accomplished manually by provision of a suitable openable and closeable valve (not shown) in or associated with the connection tube 12. It is contemplated that the compressed airstream is to be introduced into the silver guide conduit 4 only when necessary for drawing the silver 15 into and through the conduit 4 during a start-up operation, as aforementioned. Once the silver 15 is properly threaded through the guide conduit 4 and the calendar rollers 3, the airstream is interrupted.

Figure 2:
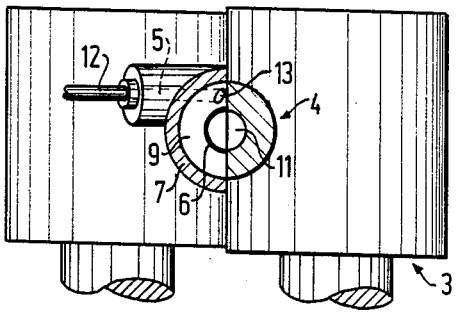
FIG. 2 is a cross-sectional view of the silver guide conduit of FIG. 1, taken along line II—II thereof.

As shown in FIGS. 1 and 2, the air conduit 5 and the downstream conduit section 7 are formed integrally as a single one-piece unit with the air conduit 5 oriented tangentially with respect to the interior area 9 of the conduit section 7 so that the discharge opening 13 of the air conduit 5 empties tangentially into the area 9 annularly about and upstream of the terminal end 8 of the conduit section 6, as above described. The compatible frusto-conical shapes of the interior conduit walls defining the interior area 9 and the outer periphery 10 of the terminal conduit section end 8 extending into the area 9 advantageously achieves a venturi-like injector action of the airstream which considerably improves the transport of the fibrous structure of the silver 15 from the output rollers 2 via the funnel 14 and the guide conduit 4 to the calendar rollers 3 in a simple manner.

It is also contemplated that the airstream may be directed onto an open or closed pair of the calendar rollers 3. If the calendar rollers 3 are separated or open, the airstream is enabled to transport the silver 15 in an unimpeded manner through the nip area between the calendar rollers 3. On the other hand, if the calendar rollers 3 are closed, the airstream effectively introduces the silver to the nip line between the rollers to be immediately grasped and transported between the rollers.

It will therefore be readily understood by those persons skilled in the art that the present invention is susceptible of a broad utility and application. Many embodiments and adaptions of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. In a textile draw frame or a like spinning preparation machine having serially-arranged silver output rollers and calendar rollers, a bipartite silver guide conduit for transporting a traveling silver between said output rollers and said calendar rollers, said silver guide conduit having an upstream conduit section arranged to receive the silver from said output rollers and a downstream conduit section arranged to discharge the silver to said calendar rollers, said upstream conduit section having an end terminating interiorly within said downstream conduit section, said downstream conduit section and said terminal end of said upstream conduit section defining an annular airspace therebetween which opens annularly into said downsteam conduit section, and air conduit means associated with said silver guide conduit for directing an airstream interiorly into said annular airspace generally tangentially thereto at a location upstream of said terminal end of said upstream conduit section for generating a rotational current of the airstream within said downstream conduit section to impart corresponding rotation to the sliver.

2. A silver guide conduit in a textile draw frame or like spinning preparation machine according to claim 1 and characterized further in that said downstream conduit section defines a frusto-conical interior area receiving said terminal end of said upstream conduit section.

3. A silver guide conduit in a textile draw frame or like spinning preparation machine according to claim 2 and characterized further in that said downstream conduit section defines an interior silver transport area extending downstream from said conical interior area to said calendar rollers.

4. A silver guide conduit in a textile draw frame or like spinning preparation machine according to claim 1 and characterized further in that said terminal end of said upstream conduit section is of a frusto-conical shape.

5. A silver guide conduit in a textile draw frame or like spinning preparation machine according to claim 1 and characterized further in that said downstream conduit section and said air conduit means are formed as an integral unit.

6. In a textile draw frame or a like spinning preparation machine having serially-arranged silver output rollers and calendar rollers, a bipartite silver guide conduit for transporting a traveling silver between said output rollers and said calendar rollers, said silver guide conduit having an upstream conduit section arranged to receive the silver from said output rollers and a downstream conduit section arranged to discharge the silver to said calendar rollers, said upstream conduit section having a terminal end of a frusto-conical shape extending interiorly within said downstream conduit section. and air conduit means associated with said silver guide conduit for directing an airstream interiorly into said downstream conduit section generally tangentially thereto at a location upstream of said terminal end of said upstream conduit section for generating a rotational current of the airstream within said downstream conduit section to impart corresponding rotation to the silver.

* * * * *